US006508725B1

(12) United States Patent
Kim

(10) Patent No.: US 6,508,725 B1
(45) Date of Patent: Jan. 21, 2003

(54) GOLF BALL COMPOSITION AND METHOD OF MANUFACTURE

(75) Inventor: Hyun Jin Kim, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 09/838,538

(22) Filed: Apr. 18, 2001

(51) Int. Cl.[7] ..... A63B 37/12; A63B 37/06

(52) U.S. Cl. ..... 473/373; 473/371; 473/374; 473/377; 473/378; 473/370; 473/373; 525/89; 525/93

(58) Field of Search ..... 473/356; 428/212; 525/911, 88, 89, 93; 273/DIG. 10; 260/998.14

(56) References Cited

U.S. PATENT DOCUMENTS 4,350,795 A * 9/1982 Bohm et al. ..... 525/194
4,986,545 A * 1/1991 Sullivan ..... 260/998.14
5,393,837 A * 2/1995 Kinoshita et al. ..... 525/911
5,504,156 A * 4/1996 Takezaki et al. ..... 525/93
5,616,418 A * 4/1997 Vasselin et al. ..... 428/474.7
5,693,711 A * 12/1997 Akiba et al. ..... 473/356
5,827,167 A * 10/1998 Dougan et al. ..... 273/DIG. 10
5,873,796 A * 2/1999 Cavallaro et al. ..... 428/212
5,981,658 A * 11/1999 Rajagopalan et al. ..... 525/72
6,096,830 A * 8/2000 Takemura et al. ..... 525/192
6,150,462 A * 11/2000 Rajagopalan et al. ..... 525/74
6,334,820 B1 * 1/2002 Sasaki ..... 473/374
6,384,136 B1 * 5/2002 Rajagopalan et al. ..... 525/72
6,461,252 B1 * 10/2002 Yamagishi et al.

OTHER PUBLICATIONS

Efunda, Properties of Thermoplastic elastomers, Nov. 09, 2001, WWW.efunda.com, Search: Thermoplastic elastomers.*

* cited by examiner

*Primary Examiner*—Paul T. Sewell
*Assistant Examiner*—T. Duong
(74) *Attorney, Agent, or Firm*—Sheppard, Mullin, Richter & Hampton LLP; Oral Caglar

(57) ABSTRACT

Golf ball compositions for use in ball covers and intermediate layers incorporate a specified block copolymer and are essentially free of ionomeric material. The compositions are outside the scope of those previously considered suitable for use in ball covers and intermediate layers. When used in ball covers, the composition provides for improved ball performance with respect to spin rate, feel, and durability. When used in ball intermediate layers, the composition provides for improved ball performance with respect to spin rate and distance. Also, a method for making a golf ball includes preparing a composition essentially free of ionomeric material including the specified block copolymer, and then incorporating the composition into a golf ball.

30 Claims, No Drawings

GOLF BALL COMPOSITION AND METHOD OF MANUFACTURE

BACKGROUND OF THE INVENTION

This invention relates generally to golf ball compositions and, more particularly, to golf ball compositions for use in making golf ball covers and intermediate layers, to optimize ball performance. This invention also relates to methods of manufacture of such ball compositions.

Golf balls generally include a core and at least one layer surrounding the core. Balls can be classified as two-piece, wound, or multi-layer balls. Two-piece balls include a spherical inner core and an outer cover layer. Wound balls include a core, a rubber thread wound under tension around the core to a desired diameter, and a cover layer. Cover layers for wound ball generally are made of balata material. Multi-layer balls include a core, a cover layer, and one or more intermediate layers.

Generally, two-piece balls have good durability and distance when hit, but poor "feel"—the overall sensation transmitted to the golfer while hitting the ball—and low spin rate, which results in poor ball control. Wound balls having balata covers generally have high spin rate, leading to good control, and they also have good feel, but they have poor durability and short distance in comparison to two-piece balls. Multi-layer balls generally have performance characteristics between those of two-piece and wound balls; that is, multi-layer balls exhibit durability and distance inferior to two-piece balls but superior to wound balata balls, and they exhibit feel and spin rate inferior to wound balata balls but superior to two-piece balls.

Material characteristics of the compositions used in the core, cover, and any intermediate layers of golf balls are among the important factors that determine the performance of the balls. In particular, the composition of the cover layer is important in determining the ball's durability, shear-cut resistance, speed, spin rate, hitting sound (the sound made by a golf club head when it hits the ball), and feel. The composition of an intermediate layer is important in determining the ball's spin rate and speed. Various materials having different physical properties are used to make cover and intermediate layers to create a ball having the most desirable performance possible. In particular, cover layers of many commercially available balls are made using soft or hard ionomeric resins, elastomeric resins, or blends of these.

Ionomeric resins used generally are ionomeric copolymers of an olefin and a metal salt of a unsaturated carboxylic acid, or ionomeric terpolymers having a co-monomer within its structure. These resins vary in resiliency, flexural modulus, and hardness. Examples of these resins include those marketed under the trademark SURLYN manufactured by E.I. DuPont de Nemours & Company of Wilmington, Del., and IOTEK manufactured by ExxonMobil Corporation of Irving, Tex. Ionomeric copolymers have been have been particularly favored for use in golf ball covers because they produce ball covers having excellent durability and high resilience. Ionomeric terpolymers are used to produce covers having improved spin and feel, though at the cost of ball speed and durability.

Elastomeric resins used in golf ball covers include a variety of thermoplastic or thermoset elastomers available, such as polyurethane, polyetherester elastomer, and polyamide elastomer. Another elastomeric material considered suitable for use in golf ball compositions is a block polymer having at least one polymer block comprising an aromatic vinyl compound and at least one polymer block comprising a conjugated diene compound, and having a hydroxyl group, or its hydrogenated product. The hydroxyl group can be at the terminal block copolymer or elsewhere in the block copolymer structure. An example of this block copolymer having a hydroxyl group at the terminal block copolymer is sold under the trademark HG-252 by Kuraray Company of Kurashiki, Japan.

Each of the materials discussed above has particular characteristics that can lead to good golf ball properties when used in a golf ball composition, either for making a ball cover or intermediate layer. However, one material generally cannot optimize all of the important properties of a golf ball layer. Properties such as feel, speed, spin rate, resilience, and durability all are important, but improvement of one of these properties by use of a particular material often can lead to worsening of another. For example, ideally, a golf ball cover should have low hardness, high spin rate, and good feel, without sacrificing ball speed, distance, or durability. Despite the broad use of copolymeric ionomers in golf balls, their use alone in, for example, a ball cover can be unsatisfactory. A cover providing good durability, spin, and feel would be difficult to make using only a copolymeric ionomer resin having a high flexural modulus, because the resulting cover, while having good distance and durability, also will have poor feel and low spin rate, leading to reduced controllability of the ball. Also, use of particular elastomeric resins alone can lead to compositions having unsatisfactory properties, such as poor durability and low ball speed.

Therefore, to improve golf ball properties, the materials discussed above can be blended to produce improved ball layers. Prior compositions for golf balls have involved blending high-modulus copolymeric ionomer with, for example, lower-modulus copolymeric ionomer, terpolymeric ionomer, or elastomer, such as the block copolymer discussed above. As discussed above, ideally a golf ball cover should provide high spin rate and good feel, without sacrificing the ball's distance and durability. Therefore, a copolymeric ionomer having a high flexural modulus often is combined in a cover composition with a terpolymeric ionomer or an elastomer having a low flexural modulus. The resulting intermediate-modulus blend possesses a good combination of hardness, spin, and durability. Also, the prior understanding of use of the above-specified block copolymers is that it is essential to use them in combination with ionomers to produce satisfactory golf ball compositions. Use of this material with ionomers in golf ball compositions has previously been disclosed in, for example, U.S. Pat. No. 5,693,711 to Akiba et al. It has been believed that use of the block copolymer in ball cover compositions without blending it with ionomer would result in loss of durability, scuff resistance, and ball speed.

However, even with blending of materials to improve properties, use of the materials and blends discussed above has not been completely satisfactory. Improving one characteristic can lead to worsening another. For example, blending an ionomer having a high flexural modulus with an ionomer having a low flexural modulus can lead to reduced resilience and durability compared to use of the high-modulus ionomer alone. Also, blends of ionomer with the above-specified block copolymer, as described in the Akiba et al. patent, are not completely satisfactory in providing optimal ball cover properties. In general, it is difficult to make a material for a golf ball cover layer that has low hardness, good feel, high speed, high resilience, and good shear durability. Additional compositions meeting these criteria therefore are needed.

In view of the above, it is apparent that golf ball compositions are needed that allow the optimization of many ball performance properties without the worsening of other properties. The ball compositions also should provide little or no processing and preparation difficulties over existing compositions. The present invention fulfills this need and other needs, and provides further related advantages.

SUMMARY OF THE INVENTION

The present invention is embodied a golf ball composition incorporating a block copolymer having a first polymer block comprising an aromatic vinyl compound, a second polymer block comprising a conjugated diene compound, and a hydroxyl group, or its hydrogenation product, wherein the composition is essentially free of ionomer. The composition preferably includes a second polymer having a Shore D hardness greater than about 30, more preferably greater than about 40, and most preferably greater than about 50. The second polymer preferably has a flexural modulus greater than about 10,000 psi, more preferably greater than about 20,000 psi, and most preferably greater than about 30,000 psi.

Particularly preferred second polymers in the composition include polyamide, polyamide copolymer, polycarbonate, polypropylene, polyarylate, polyolefin, polyphenylene ether, modified-polyphenylene ether, polystyrene, diallyl phthalmate polymer, styrene-acrylonitrile, styrene-maileic anhydride, liquid crystal polymer, cellulose polymer, polyurethane, and polyester. Particularly preferred polyesters include poly(ethylene terepthalate) and poly(butylene terepthalate). Compositions within the scope of the present invention also can include fibers, fillers, stabilizers, colorants, mold release agents, processing aids, and antioxidants, or mixtures thereof.

The present invention also is embodied in a golf ball having a core and a cover, the cover comprising a composition as described above. The composition of the cover preferably comprises from about 5% to about 95% by weight of the block copolymer, more preferably from about 10% to about 80%, and most preferably from about 10% to about 70%. The core of the golf ball can incorporate an inner core and one or more outer cores encasing the inner core, and the core can be liquid. The ball can also incorporate one or more layers situated between the core and the cover, such as a layer of rubber thread.

The present invention also is embodied in a golf ball having an intermediate layer situated between the core and the cover, the intermediate layer comprising a composition as described above. The composition of the intermediate layer preferably comprises from about 5% to about 95% by weight of the block copolymer, more preferably from about 10% to about 90%, and most preferably from about 20% to about 80%.

Particular embodiments of the present invention are golf ball covers, essentially free of ionomer, comprising: polycarbonate and from about 60% to about 90% by weight of the above-specified block copolymer; poly(butylene terephthalate) from about 70% to about 80% by weight of the above-specified block copolymer; and, polyamide and from about 70% to about 90% by weight of the above-specified block copolymer. Additional particular embodiments of the present invention are golf ball intermediate layers, essentially free of ionomer, comprising: polycarbonate and from about 60% to about 90% by weight of the above-specified block copolymer; polyamide/polyphenylether alloy and from about 70% to about 90% by weight of the above-specified block copolymer; and, poly (butylene terephthalate) from about 70% to about 80% by weight of the above-specified block copolymer.

The invention also is embodied in a method for making a golf ball including preparing a composition essentially free of ionomer that includes the above-specified block copolymer and incorporating the composition into a golf ball.

Other features and advantages of the present invention should become apparent from the following detailed description of the preferred embodiments.

DESCRIPTION OF THE PREFERRED EMBODIMENTS

The present invention is embodied in a golf ball composition that includes a block polymer having at least one polymer block comprising an aromatic vinyl compound and at least one polymer block comprising a conjugated diene compound, and having a hydroxyl group, or its hydrogenated product in a composition essentially free of ionomeric polymer. That is, the composition does not include an ionomeric material as has been considered necessary for good ball performance, particularly when using the specified block copolymer. The invention also is embodied in a golf ball cover and a golf ball intermediate layer made from the above-described composition. The invention also is embodied in a method of manufacture of such a ball composition. When used in a cover or intermediate layer for a golf ball, the composition provides for excellent ball properties without introducing processing difficulties.

In view of prior disclosure and use of the specified block copolymer in golf ball compositions, it has been surprisingly found that including this block copolymer in golf ball compositions without inclusion of ionomer produces golf ball compositions that provide excellent ball properties. In particular, cover layers incorporating these compositions are both soft and durable. The covers possess good shear-cut resistance, while retaining good ball speed, feel and spin rate. Typically, these properties are difficult to optimize in a single cover composition. Also, intermediate layers incorporating these compositions possess a good combination of ball speed and spin rate.

Use of non-ionomeric polymers in the composition instead of ionomers provides substantial processing and manufacturing benefits. For example, because of the relatively low melting points of ionomers (approximately 81° C. to 96° C.), use of ionomers in golf ball compositions can present limitations on processing of the golf ball. In coating or pad-print a ball, the coating or print material must be dried or cured at relatively high temperature. Using ionomer blends, it is necessary to avoid temperatures that might melt the ionomer blend. These required lower temperatures can lead to increased drying and curing times. Because the non-ionomeric polymers used in the present invention have generally higher melting points, this processing limitation is avoided. Also, ionomers are available having only a relatively limited range of flex moduli. This limited range restricts the flex modulus range of the resulting blends. Non-ionomeric polymers used in the present invention can have a wide variety of flex moduli, making it easier to tailor the modulus of the resulting blend as necessary.

Non-ionomeric polymers suitable for use in the compositions of the present invention have a Shore D hardness greater than 30, preferably greater than 40, and most preferably greater than 50. These non-ionomeric polymers also have flexural modulus greater than 10,000 psi, preferably greater than 20,000 psi, and most preferably greater than 30,000 psi. Particular suitable non-ionomeric polymers for use in the compositions of the present invention include polycarbonate, polyolefin, polyamide, polyesters, polyurethane, polyarylate, polyacrylate, polyphenyl ether, modified-polyphenyl ether, high-impact polystyrene, diallyl phthalate polymer, acrylonitrile-styrene-butadiene (ABS), styrene-acrylonitrile (SAN) (including olefin-modified SAN and acrilonitrile styrene acrylonitrile), styrene-maleic anhydryde (S/MA) polymer, cellulose polymer, and liquid crystal polymer (LCP). Some examples of suitable non-ionomeric polymers include those sold under the trademarks LEXAN and VALOX marketed by GE Plastics of Pittsfield, Mass., CRISTAMID and RILSAN marketed by ATOFINA Chemicals of Philadelphia, Pa., GRILAMID marketed by EMS-CHEMIE of Sumter, S.C., TENITE marketed by Eastman Chemical Company of Kingsport, Tenn., EXXPOL marketed by ExxonMobil Corporation and ESTANE marketed by BFGoodrich of Cleveland, Ohio.

Preferred embodiments of the compositions of the present invention for use in making golf ball covers include blends of the specified block copolymer and the additional non-ionomeric polymer with blend percentages of the specified block copolymer ranging from about 5% to about 95% by weight, more preferably from about 10% to about 80% by weight, and most preferably from about 10% to about 70% by weight. Golf ball covers incorporating these compositions provide superior ball properties, including good hit feel, high spin rates, high ball speed, and high durability.

Preferred embodiments of the compositions of the present invention for use in making golf ball intermediate layers include blends of the specified block copolymer and the additional non-ionomeric polymer with blend percentages of the specified block copolymer ranging from about 5% to about 95% by weight, more preferably from about 10% to about 90% by weight, and most preferably from about 20% to about 80% by weight. Golf ball intermediate layers incorporating these compositions provide flexibility in ball design to improve spin rate, hit feel, and ball speed without adversely affecting durability.

Additional non-ionomeric polymers suitable for use in the present invention with the specified block copolymer include any of the non-ionomeric polymer materials commonly used in golf ball compositions, such as thermoplastic elastomer, thermoplastic elastomer modified with various functional or polar groups, thermoplastic rubber, thermoset rubber, thermoset elastomer, dynamically vulcanized thermoplastic elastomers, metallocene polymer or blends of thereof. Examples of suitable elastomers include: polyether-ester elastomer; polyetheramide elastomer; propylene-butadiene copolymer; modified copolymers of ethylene and propylene; styrenic copolymers, including styrenic block copolymers and randomly distributed styrenic copolymers, such as styrene-isobutylene copolymers; ethylene-vinyl acetate copolymers (EVA); 1,2-polybutadiene; styrene-butadiene copolymers; dynamically vulcanized PP/EPDM; and, polyether or polyester thermoplastic urethanes, as well as thermoset polyurethanes.

Any colorants, stabilizers, antioxidants, processing aids, fibers, fillers, or mold release agents commonly used in the manufacture of golf balls also can be used in the compositions of the present invention. Ball compositions of the present invention can be used in covers or intermediate layers of a variety of ball designs, including two-piece, multi-layer, and wound balls, and with balls having solid, liquid, or multi-layer cores.

EXAMPLE

Golf balls were prepared having either covers or intermediate layers made from compositions within the scope of the present invention. The balls all had cores that were prepared in an identical manner. The ball cover and intermediate layer compositions were manufactured using conventional compounding techniques. The particular balls prepared are described below.

I. Compositions Used

A. Balls Having Covers Within the Scope of the Invention ("Cover Test Balls")

Cover test balls, labeled Types #1 to #10, were prepared in which the ball covers comprised from 60% to 90% by weight of the HG-252 material described above. The remainder of the cover compositions comprised one of four non-ionomeric polymer materials: LEXAN 141, a polycarbonate resin; VALOX 315, a poly(butylenetherephthalate) resin; CRISTAMID 1700, a polyamide resin; and RILSAN, a polyamide. The cover test balls also incorporated identical intermediate layers. These intermediate layers comprised a composition of polyamide elastomer and high acid ionomer having a Shore D hardness of 40 and exhibiting high resilience. The compositions, flexural moduli, and hardnesses of the materials used in the covers are shown below in Table 1.

TABLE 1

Cover Test Balls

| Ball Type | HG-252 wt % | Lexan 141 wt % | Valox 315 wt % | Cris-tamid 1700 wt % | Rislan wt % | Flex Mod. psi | Hardness Shore D |
|---|---|---|---|---|---|---|---|
| 1 | 90 | 10 | 0 | 0 | 0 | 25,400 | 32 |
| 2 | 80 | 20 | 0 | 0 | 0 | 27,200 | 34 |
| 3 | 70 | 30 | 0 | 0 | 0 | 33,000 | 36 |
| 4 | 60 | 40 | 0 | 0 | 0 | 41,400 | 38 |
| 5 | 80 | 0 | 20 | 0 | 0 | 38,600 | 41 |
| 6 | 70 | 0 | 30 | 0 | 0 | 49,200 | 42 |
| 7 | 70 | 0 | 0 | 30 | 0 | 15,200 | 36 |
| 8 | 90 | 0 | 0 | 0 | 10 | 21,800 | 31 |
| 9 | 80 | 0 | 0 | 0 | 20 | 24,700 | 36 |
| 10 | 70 | 0 | 0 | 0 | 30 | 27,300 | 39 |

B. Balls Having Intermediate Layers Within the Scope of the Invention ("Intermediate Layer Test Balls")

Intermediate layer test balls, labeled Types #12 to #22, were prepared in which the intermediate layers comprised from 60% to 90% by weight of the HG-252 material described above. The remainder of the intermediate layer compositions comprised one of three non-ionomeric polymer materials: LEXAN 141; NORYL GTX 902 a polyamide/polyphenylether alloy marketed by GE Polymerland of Huntersville, N.C.; and VALOX 315. For comparison purposes, balls having intermediate layers outside the scope of the invention also were prepared, designated below as Ball C (for "comparison"). The intermediate layers in these comparison balls comprised a composition of polyamide elastomer and high acid ionomer, the composition having a Shore D hardness of 40 and exhibiting high resilience.

The intermediate layer test balls incorporated identical cover layers having a Shore D hardness of 60. The compositions, hardnesses, and PGA compressions of the intermediate layers are shown below in Table 2.

TABLE 2

Intermediate Layer Test Balls

| Ball Type | HG-252 wt % | Lexan 141 wt % | Noryl GTX 902 wt % | Valox 315 wt % | Intermed. Layer Hardness Shore D | PGA Com-pression |
|---|---|---|---|---|---|---|
| 11 | 90 | 10 | 0 | 0 | 32 | 79 |
| 12 | 80 | 20 | 0 | 0 | 34 | 78 |
| 13 | 70 | 30 | 0 | 0 | 36 | 79 |
| 14 | 60 | 40 | 0 | 0 | 38 | 81 |
| 15 | 90 | 0 | 10 | 0 | 33 | 78 |
| 16 | 80 | 0 | 20 | 0 | 38 | 78 |
| 17 | 70 | 0 | 30 | 0 | 40 | 78 |
| 18 | 60 | 0 | 40 | 0 | 46 | 80 |
| 19 | 90 | 0 | 0 | 10 | 35 | 77 |
| 20 | 80 | 0 | 0 | 20 | 41 | 78 |
| 21 | 70 | 0 | 0 | 30 | 42 | 78 |
| C | — | — | — | — | 40 | 81 |

II. Testing

A. Cover Test Balls

Each of the cover test balls was tested for surface hardness on the Shore D scale (as distinguished from the material hardnesses shown in Tables 1 and 2) and also for spin rate and speed when hit with an 8-iron. The cover test balls except for Type #10, also were tested for shear resistance by hitting them with a pitching wedge at controlled speed. Three of each type of ball were used for this testing. Each ball was hit twice, to collect two impact data points per ball. Then, each ball was assigned two numerical scores-one for each impact-from 1 (no visible damage) to 5 (substantial material displaced). These scores were averaged for each ball type to produce the shear resistance numbers below.

In addition to the cover test balls, several golf balls currently available on the market were tested for the same parameters. These balls included the Titleist Professional, Titleist Tour Balata, manufactured by Acushnet Corporation of Fairhaven, Mass. and also the InerGel Pro Distance, manufactured by Taylor Made Golf Company of Carlsbad, Calif.

B. Intermediate Layer Test Balls

Each of the intermediate layer test balls was tested for spin rate and speed when hit with an 8-iron and with a driver. In addition to intermediate layer test balls, golf balls currently available on the market were tested for comparison. The Titleist Professional, marketed by Acushnet Company, was tested for all of the same parameters, and the Pinnacle Gold LS, also marketed by Acushnet Company, was tested for driver properties only.

III. Results

Results of the tests on the cover test balls are shown below in Table 3.

TABLE 3

Performance of Cover Test Balls

| Ball Type | Hardness (Shore D) | 8 Iron Spin (rpm) | 8 Iron Speed (mph) | Shear Resistance |
|---|---|---|---|---|
| 1 | 42 | 9,496 | 108.2 | 2.2 |
| 2 | 43 | 9,592 | 108.3 | 2.2 |
| 3 | 45 | 9,531 | 108.7 | 2.4 |
| 4 | 43 | 9,239 | 108.0 | 3.0 |
| 5 | 43 | 9,444 | 108.3 | 2.3 |
| 6 | 45 | 9,435 | 108.6 | 2.3 |
| 7 | 38 | 9,374 | 108.4 | 3.3 |
| 8 | 41 | 9,930 | 108.3 | 1.9 |

TABLE 3-continued

Performance of Cover Test Balls

| Ball Type | Hardness (Shore D) | 8 Iron Spin (rpm) | 8 Iron Speed (mph) | Shear Resistance |
|---|---|---|---|---|
| 9 | 41 | 9,704 | 108.1 | 1.8 |
| 10 | — | 9,354 | 108.7 | — |
| Titleist Professional | 58 | 8,072 | 107.6 | 2.4 |
| Titleist Tour Balata | 48 | 8,967 | 109.4 | 4.4 |
| Taylor Made InerGel Pro Distance | 61 | 8,203 | 111.1 | 1.6 |

Results of the tests on the intermediate layer test balls and comparison balls are shown below in Table 4.

TABLE 4

Performance of Intermediate Layer Test Balls

| Ball Type | 8 Iron Spin (rpm) | 8 Iron Speed (mph) | Driver Spin (rpm) | Driver Speed (rpm) |
|---|---|---|---|---|
| 11 | 7,994 | 108.8 | 3,130 | 161.4 |
| 12 | 7,838 | 109.0 | 3,151 | 160.9 |
| 13 | 7,812 | 108.6 | 3,162 | 160.8 |
| 14 | 7,708 | 108.9 | 3,109 | 160.8 |
| 15 | 7,907 | 109.2 | 3,130 | 161.3 |
| 16 | 7,552 | 109.0 | 3,055 | 161.0 |
| 17 | 7,751 | 108.8 | 3,162 | 161.0 |
| 18 | 7,595 | 108.7 | 3,098 | 161.1 |
| 19 | 7,890 | 108.5 | 3,205 | 160.9 |
| 20 | 7,847 | 108.9 | 3,226 | 161.3 |
| 21 | 7,630 | 108.3 | 3,151 | 160.7 |
| C | 7,698 | 108.3 | 3,023 | 161.2 |
| Titleist Professional | 8,072 | 107.6 | 3,504 | 159.9 |
| Pinnacle Gold | 7,180 | 107.8 | 2,959 | 160.3 |

IV. Discussion

A. Cover Test Balls

The cover test balls demonstrated 8 Iron spin rates far higher than those exhibited by any of the comparison balls. The cover test balls demonstrated speed comparable to that of the Titleist balls, but with much higher spin rate. When compared to the Taylor Made InerGel Pro Distance ball, the cover test balls demonstrated lower speed, but with much higher spin rate. The cover test balls also exhibited much lower hardness than the comparison balls, leading to enhanced ball feel. This enhanced feel was not at the expense of ball speed.

As discussed above, high 8 Iron spin rate is desirable because it allows for improved control of the ball when hit. High ball speed is desirable because it leads greater flying distance of the ball, and low cover hardness and PGA compression provide for improved ball feel. The cover test balls generally demonstrated ball speeds higher than or roughly equal to that of the comparison balls, despite the fact that low ball hardness generally leads to reduced ball speed. Balls incorporating covers within the scope of the present invention, therefore, overcome design limitations previously known in the manufacture of golf balls, i.e., that softer ball covers generally provide reduced ball speeds. These balls provide good spin rate and feel along with good speed, which leads to greater distance. These characteristics are attained without the use of ionomers, as has been considered necessary in cover compositions containing the specified block copolymer.

Additionally, the cover test balls demonstrated shear impact resistance, and therefore durability, either comparable to or far superior to that of the comparison balls. In particular, Type #8 and #9 balls exhibited durability comparable to the Taylor Made InerGel Pro Distance, and Type #1–3 and 5–6 balls exhibited durability comparable to the Titleist Professional balls. All of the cover test balls demonstrated shear resistance far better than that of the Titleist Tour Balata balls.

In general, even though low cover hardness typically leads to poor shear resistance, cover test balls generally exhibited durability equal to or better than the harder comparison balls. As mentioned above, the test balls provide for ball feel comparable to that of wound balata balls, but with far superior durability. Overall, the test results for shear resistance indicate that balls incorporating cover compositions within the scope of the present invention provide for a combination of low cover hardness and high shear resistance in comparison to balls currently available.

Generally, it is difficult to produce golf balls having high 8 Iron spin rate and speed (and therefore good distance), soft feel, and good durability. The cover test balls exhibited all of these. As discussed above, these performance results contradict the prior understanding of the need for incorporation of ionomer into golf ball cover compositions that include the above-specified block copolymer. The performance of the test balls demonstrates the utility of the ball covers of the present invention in maximizing desirable ball properties.

B. Intermediate Layer Test Balls

All of the intermediate layer test balls demonstrated ball speeds generally equal to or greater than the comparison balls. In particular, the intermediate layer test balls demonstrated driver speed comparable to that of comparison Ball C, but with generally higher 8 Iron speed and 8 Iron spin rates. The intermediate layer test balls demonstrated 8 Iron spin rates comparable to that of the Titleist Professional, but with substantially greater driver and 8 Iron speeds. With respect to the Pinnacle Gold balls, the intermediate layer test balls demonstrated generally greater ball speed and 8 Iron spin rates. The Pinnacle Gold balls are considered to be distance balls, providing high speed at the expense of spin rate. However, the intermediate layer test balls provided generally greater speed, and therefore distance, while maintaining higher spin rates than the Pinnacle Gold balls. The data overall shows that the intermediate layer test balls are able to provide the high driver speed of the Pinnacle Gold ball, while also providing the high 8 Iron spin rate of the Titleist Professional.

The tests indicate that balls incorporating intermediate layers within the scope of the present invention overcome design limitations previously known in the manufacture of golf balls by providing a combination of high speed, and therefore distance, and high 8 Iron spin rate, and therefore controllability. As for the cover compositions, these characteristics are attained using the specified block copolymer without the use of ionomers, as has been considered necessary.

Although the invention has been disclosed in detail with reference only to the preferred embodiments, those skilled in the art will appreciate that additional golf ball covers can be made without departing from the scope of the invention. Accordingly, the invention is identified by the following claims.

I claim:

1. A golf ball composition that incorporates a block copolymer comprising:

a first polymer block comprising an aromatic vinyl compound;

a second polymer block comprising a conjugated diene compound; and a hydroxyl group, or its hydrogenation product;

wherein the composition is essentially free of ionomer.

2. A golf ball composition as defined in claim 1, further comprising, in addition to the block copolymer, a second polymer having a Shore D hardness greater than about 30.

3. A golf ball composition as defined in claim 2, wherein the second polymer has a Shore D hardness greater than about 40.

4. A golf ball composition as defined in claim 3, wherein the second polymer has a Shore D hardness greater than about 50.

5. A golf ball composition as defined in claim 1, further comprising, in addition to the block copolymer, a second polymer having a flexural modulus greater than about 10,000 psi.

6. A golf ball composition as defined in claim 5, wherein the second polymer has a flexural modulus greater than about 20,000 psi.

7. A golf ball composition as defined in claim 6, wherein the second polymer has a flexural modulus greater than about 30,000 psi.

8. A golf ball composition as defined in claim 1, further comprising, in addition to the block copolymer, a second polymer selected from the group consisting of polyamide, polyamide copolymer, polyacrylate, polycarbonate, polypropylene, polyarylate, polyolefin, polyphenyl ether, modified-polyphenyl ether, polystyrene, diallyl phthalmate polymer, styrene-acrylonitrile, styrene-maileic anhydride, liquid crystal polymer, cellulose polymer, polyurethane, and polyester, and mixtures thereof.

9. A golf ball composition as defined m claim 1, further comprising, in addition to the block copolymer, a second polymer selected from the group consisting of poly(ethylene terepthalate) or poly(butylene terepthalate).

10. A golf ball composition as defined in claim 1, further comprising, in addition to the block copolymer, a second polymer that is polyamide/polyphenylether alloy.

11. A golf ball composition as defined in claim 1, further comprising fibers, fillers, stabilizers, colorants, mold release agents, processing aids, antioxidants, or mixtures thereof.

12. A golf ball comprising a core and a cover encasing the core, the cover comprising a composition as defined in claim 1.

13. A golf ball as defined in claim 12, wherein the composition comprises from about 5% to about 95% by weight of the block copolymer.

14. A golf ball as defined in claim 13, wherein the composition comprises from about 10% to about 80% by weight of the block copolymer.

15. A golf ball as defined in claim 14, wherein the composition comprises from about 10% to about 70% by weight of the block copolymer.

16. A golf ball as defined in claim 12, wherein the core comprises an inner core and one or more outer cores encasing the inner core.

17. A golf ball as defined in claim 12, wherein the core comprises liquid.

18. A golf ball as defined in claim 12, further comprising one or more layers situated between the core and the cover.

19. A golf ball as defined in claim 12, further comprising a layer of rubber thread situated between the core and the cover.

20. A golf ball comprising a core, a cover encasing the core, and an intermediate layer situated between the core and the cover, the intermediate layer comprising a composition as defined in claim 1.

21. A golf ball as defined in claim 20, wherein the composition comprises from about 5% to about 95% by weight of the block copolymer.

22. A golf ball as defined in claim 21, wherein the composition comprises from about 10% to about 90% by weight of the block copolymer.

23. A golf ball as defied in claim 22, wherein the composition comprises from about 20% to about 80% by weight of the block copolymer.

24. A golf ball cover comprising polycarbonate and a block copolymer, the block copolymer comprising:

a first polymer block comprising an aromatic vinyl compound;

a second polymer block comprising a conjugated diene compound, and;

a hydroxyl group, or its hydrogenation product;

wherein the cover is essentially free of ionomer, and wherein the cover comprises from about 60% to about 90% by weight of the block copolymer.

25. A golf ball cover comprising poly(butylene terephthalate) and a block copolymer, the block copolymer comprising:

a first polymer block comprising an aromatic vinyl compound;

a second polymer block comprising a conjugated diene compound, and;

a hydroxyl group, or its hydrogenation product;

wherein the cover is essentially free of ionomer, and wherein the cover comprises from about 70% to about 80% by weight of the block copolymer.

26. A golf ball cover comprising polyamide and a block copolymer, the block copolymer comprising:

a first polymer block comprising an aromatic vinyl compound;

a second polymer block comprising a conjugated diene compound, and;

a hydroxyl group, or its hydrogenation product;

wherein the cover is essentially free of ionomer, and wherein the cover comprises from about 70% to about 90% by weight of the block copolymer.

27. A golf ball intermediate layer comprising polycarbonate and a block copolymer, the block copolymer comprising:

a first polymer block comprising an aromatic vinyl compound;

a second polymer block comprising a conjugated diene compound, and;

a hydroxyl group, or its hydrogenation product;

wherein the intermediate layer is essentially free of ionomer, and wherein the intermediate layer comprises from about 60% to about 90% by weight of the block copolymer.

28. A golf ball intermediate layer comprising polyamide/polyphenylether alloy and a block copolymer, the block copolymer comprising:

a first polymer block comprising an aromatic vinyl compound;

a second polymer block comprising a conjugated diene compound, and;

a hydroxyl group, or its hydrogenation product;

wherein the intermediate layer is essentially free of ionomer, and wherein the intermediate layer comprises from about 70% to about 90% by wet of the block copolymer.

29. A golf ball intermediate layer comprising poly (butylene terephthalate) and a block copolymer, the block copolymer comprising:

a first polymer block comprising an aromatic vinyl compound;

a second polymer block comprising a conjugated diene compound, and;

a hydroxyl group, or its hydrogenation product;

wherein the intermediate layer is essentially free of ionomer, and wherein the intermediate layer comprises from about 70% to about 90% by weight of the block copolymer.

30. A method for making a golf ball, comprising:

preparing a composition that is essentially free of ionomer and includes a block copolymer, the block copolymer comprising:

a first polymer block comprising an aromatic vinyl compound;

a second polymer block comprising a conjugated diene compound, and;

a hydroxyl group, or its hydrogenation product; and incorporating the composition into a golf ball.

* * * * *

UNITED STATES PATENT AND TRADEMARK OFFICE

CERTIFICATE OF CORRECTION

PATENT NO. : 6,508,725 B1
DATED : January 21, 2003
INVENTOR(S) : Hyun Jin Kim

It is certified that error appears in the above-identified patent and that said Letters Patent is hereby corrected as shown below:

Column 10,
Line 34, “m” should be -- in --.

Column 11,
Line 9, “defied” should be -- defined --.

Column 12,
Line 22, “wet” should be -- weight --.

Signed and Sealed this

Twenty-fourth Day of June, 2003

JAMES E. ROGAN
*Director of the United States Patent and Trademark Office*